US005235766A

United States Patent [19]

Fast et al.

[11] Patent Number: 5,235,766

[45] Date of Patent: Aug. 17, 1993

[54] PRODUCT INDENTIFICATION TAG FOR FLAT BAR HOOK

[75] Inventors: Jacob Fast, Fort Lauderdale, Fla.; John Gebka, Chicago Heights, Ill.

[73] Assignee: Fast Industries, Inc., Ft. Lauderdale, Fla.

[21] Appl. No.: 760,916

[22] Filed: Sep. 17, 1991

[51] Int. Cl.[5] ..... G09F 3/10

[52] U.S. Cl. ..... 40/299; 40/642; 40/657; 248/220.4; 211/59.1

[58] Field of Search ..... 40/299, 642, 657, 124.1; 248/220.4, 221.1, 221.2; 211/59.1, 57.1

[56] References Cited

U.S. PATENT DOCUMENTS 4,525,944 7/1985 Fast .
4,583,308 4/1986 Taub ..... 40/642 X
4,646,454 3/1987 Fast .
4,665,639 5/1987 Fast .
4,693,024 9/1987 Fast .
4,694,595 9/1987 Fast ..... 40/642
4,698,929 10/1987 Fast .
4,703,570 11/1987 Fast .
4,715,135 12/1987 Fast .
4,754,563 7/1988 Fast .
4,773,172 9/1988 Fast .
4,882,868 11/1989 Fast .
4,888,897 12/1989 Fast .
4,987,692 1/1991 Fast .

*Primary Examiner*—Kenneth J. Dorner
*Assistant Examiner*—Brian K. Green
*Attorney, Agent, or Firm*—Jacobson, Price, Holman & Stern

[57] ABSTRACT

A product information and display tag of plastic sheet material for a product support hook of the type having a proximal end bracket with upper and lower prongs which snap fit onto a flat horizontal support bar is herein disclosed. The tag has a mounting portion with a transverse slot which hooks over the upper prong of the bracket before it is fitted to the support bar, so that when the hook is fitted to the bar, the mounting portion is trapped between the bar and the bracket. Adjacent the mounting portion is an elongate portion of the tag which extends over the hook to its distal end and there is a turned-down label holder portion of the tag at the distal end of the hook for product information.

6 Claims, 2 Drawing Sheets

PRODUCT INDENTIFICATION TAG FOR FLAT BAR HOOK

BACKGROUND OF THE INVENTION

This invention relates to product identification and information tags for merchandise suspended from elongate horizontally orientated support hooks and the like. More particularly, the invention relates to such tags which may be readily attached to and removed from the support hooks without being subject to inadvertent removal, and which display product information forwardly of merchandise supported on a hook.

In recent years, there have been designed, for example, a number of elongate product information and identification tags, generally made of plastic sheet, for displaying the product information forwardly of items suspended from horizontal hooks which may extend, for example, from apertured support boards or the like. Examples of such earlier tags may be found, for example, in prior U.S. Pat. Nos. 4,525,944; 4,646,454; 4,665,639; 4,693,024; 4,698,929; 4,703,570 and 4,715,135.

Generally, tags of the above kind include a mounting portion for attachment to and removal from the hook at a location adjacent the board or the like, an elongate intermediate portion extending forwardly from the mounting portion along the length of the hook and the merchandise suspended therefrom, and a display portion at the distal end of the intermediate portion for the display of product information and the like.

The tags disclosed in the above noted patents are provided with mounting portions suited for different applications to different types of hooks and mountings. Frequently, for example, the support hooks may be adapted to attach to supports other than apertured boards. For example, there are in existence elongate product support hooks having mounting brackets at their proximal ends which are particularly adapted for attachment to a flat transversely extending bar. In other prior U.S. Patents, notably U.S. Pat. Nos. 4,773,172 and 4,987,692, there are disclosed product identification tags having mounting portions particularly suited for use with hooks of this type. It is an object of the present invention to provide a merchandise information and display tag structure of the general type discussed above which has a simple alternative type of mounting portion particularly adapted to be used with flat bar attached hooks.

SUMMARY OF THE INVENTION

Generally stated, the invention provides an elongate product information and display tag of the overall type discussed above, preferably being die-cut or the like from sheet plastic of the kind commonly used for such tags, and including a proximal end mounting portion for attaching the tag to a product, support hook, and an elongate intermediate portion extending from the mounting portion to extend over the hook and display product information at the distal end thereof. In particular, in accordance with the invention, the mounting portion may comprise a fold-down panel with a transversely extending slot. The tag is intended for use with support hooks of the kind having a distal end bracket comprising a plate with rearwardly projecting upper and lower prongs adapted to snap fit onto a horizontal support bar or spaced support rods. In use, the upper prong of the bracket is hooked through the transverse slot in the mounting portion of the tag before the bracket is fitted onto the bar or rods so that when the bracket is thus mounted, the mounting portion of the tag becomes securely trapped between the bar or rods and the back face of the bracket.

The invention thus provides an extremely simple, secure and versatile way of mounting the display tag on a hook of the type referred to. Additional features and advantages of the invention will be apparent from the ensuing description and claims read in conjunction with the attached drawings.

DESCRIPTION OF PREFERRED EMBODIMENTS

Figure 1:
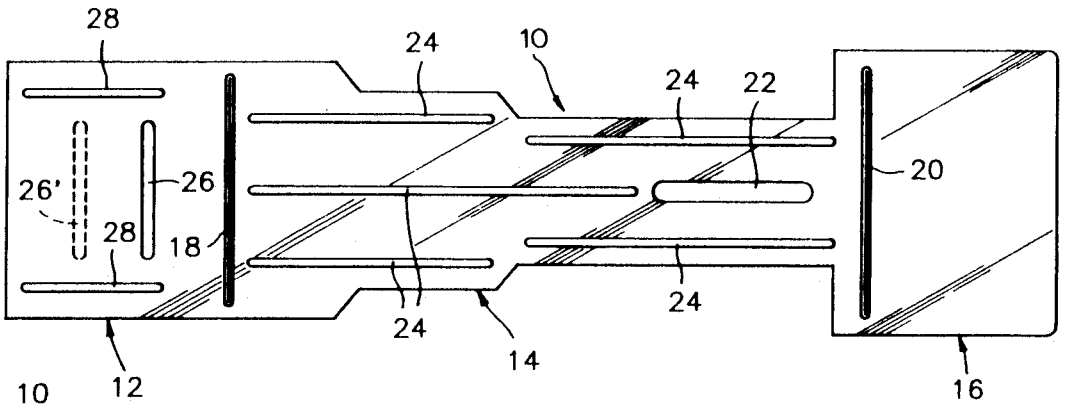
FIG. 1 a plan view of a flat plastic blank for folding into an information and display tag according to the invention.

An elongate blank 10 (FIG. 1) for folding into an information and display tag is die-cut from plastic sheet material of a kind well-known for such items and comprises generally a proximal end mounting portion 12 for attachment to the proximal end of a product support hook as will be described, an elongate stepped intermediate portion 14 for extending over the hook, and a distal end label holder portion 16 for presenting product information at the distal end of the hook.

The mounting portion 12 of the tag is separated from the intermediate portion 14 by a first transverse score or bend line 18 and likewise, the label holder portion 16 is provided with a second transverse score or bend line 20. In use, the mounting portion 12 and the label holder portion 16 are folded down substantially at right angles to the intermediate portion 14, as shown in FIG. 2.

Intermediate portion 14 of the tag is provided near its distal end with an elongate slot 22 for the upwardly turned end portion of a support hook to extend through. The intermediate portion is also provided with a plurality of longitudinal reinforcing scores or ribs 24 to provide a bowed effect which resists sagging or twisting of the tag in use. The reduction in width of the intermediate portion 14 relative to the mounting portion 12 and the label holder portion 16 is to reduce the area available for dust collection, and the stepped shape of the intermediate portion assists in optimizing usage of a sheet from which the tag is cut.

The mounting portion 12 of the tag is provided, adjacent bend line 18, with a transverse slot 26 for mounting the tag on a hook bracket as will be described. On opposite sides of the slot, the mounting portion has longitudinal reinforcing ribs or scores 28 to resist buckling of the mounting portion.

Figure 2:
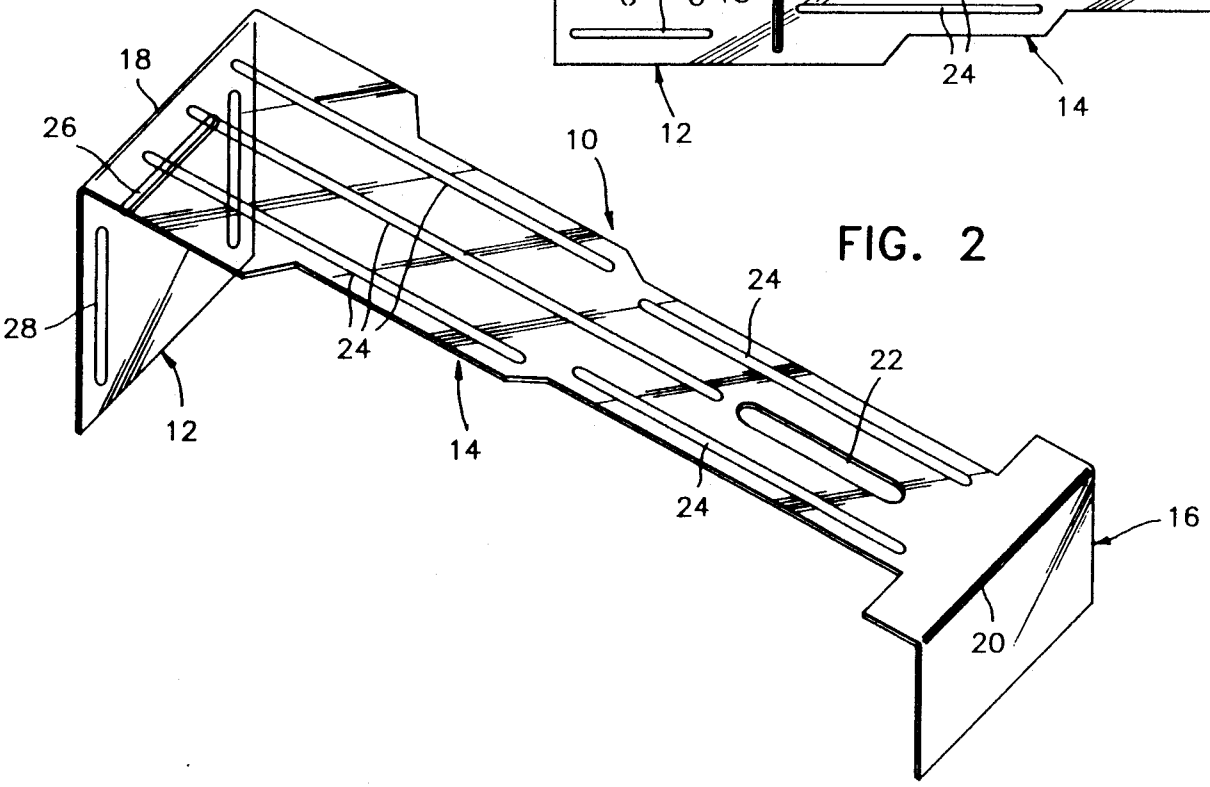
FIG. 2 is a perspective view of the tag ready for use.
Figure 3:
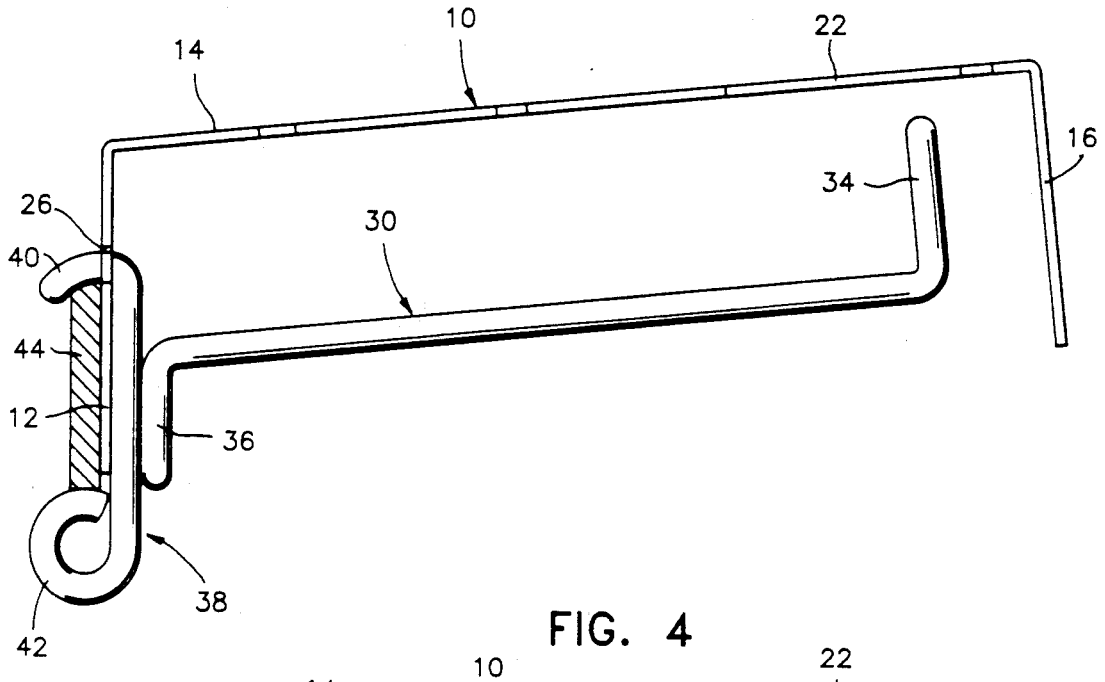
FIG. 3 is a side view of the tag applied to a first form of product support hook.
Figure 4:
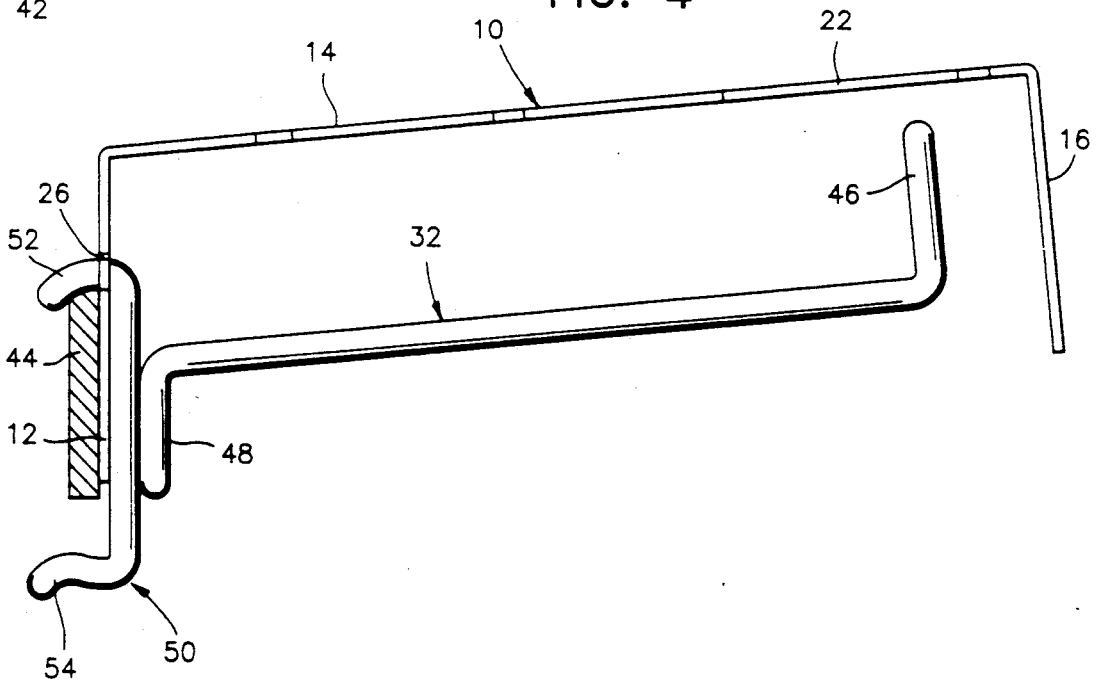
FIG. 4 is a side view of the tag applied to a second form of product support hook.

Tag 10, when folded as shown in FIG. 2, is primarily intended for use with product support hooks 30 or 32 as shown in FIGS. 3 and 4 which hooks are used to suspend apertured products such as blister packs and the like. Referring firstly to FIG. 3, hook 30 has an upturned forward end portion 34 and a downwardly turned back end portion 36 welded to a bracket 38. The bracket comprises a plate with a rearwardly extending upper prong 40 and a pair of spaced rolled lower prongs 42 separated by a gap in the plate. This is a well-known kind of hook structure which, in use, can be releasably snap fitted onto a support means in the form of a flat horizontal support bar 44 of appropriate width or to a pair of spaced horizontal support rods.

To mount tag 10 on hook 30, upper prong 40 is hooked through slot 26 from the front of mounting portion 12 before bracket 38 is fitted onto the bar 44, slot 26 being of appropriate length to accommodate prong 40. Then, when bracket 38 is fitted onto the bar, the mounting portion 12 becomes securely trapped between the bar and the back surface of the bracket. Slot 22 in the tag is used to receive portion 34 of the hook 30 in known manner. It will be evident that a product information label or the like can be applied to portion 16 of the tag.

Hook 32, shown in FIG. 4 like hook 30, has an upturned forward end 46 and a downturned back end 48 welded to a bracket 50 again in the form of a plate with an upper rearwardly extending prong 52. In place of the rolled lower prongs 42 of the hook 30, bracket 50 has a single lower prong 54 of reduced width. The mounting of tag 10 on hook 32 and the mounting of hook 32 on bar 44 is the same however, as in the previous embodiment.

The spacing of slot 26 in relation to bend line 18 determines the height of intermediate portion 14 above hook 30 or hook 32. In case this height needs to be increased, for example to accommodate products in which the suspension aperture is further from the top of the product, mounting portion 12 of the tag may be provided with a further slot 26' shown dotted in FIG. 1 and which is further from the bend line by the appropriate distance.

While only preferred embodiments of the invention have been described herein in detail, the invention is not limited thereby and modifications can be made within the scope of the attached claims.

We claim:

1. In combination; a substantially horizontally extending support means, a product support hook having a proximal end plate-like bracket releasably attaching the hook to the support means, which is substantially perpendicular to the hook, the bracket having upper and lower prongs protruding rearwardly from the bracket and gripping the support means therebetween with a snapfit, and a product information and display tag of sheet material comprising a substantially planar mounting portion with a first transverse slot, the upper prong of said bracket extending through the slot so that a part of the mounting portion is trapped between the support means and the bracket, the mounting portion having an upper edge above the bracket, the tag further including an elongate portion extending substantially horizontally from said upper edge over the hook to a distal end of the hook for presenting product information at said distal end.

2. The combination as defined in claim 1 wherein the tag further comprises a distal end label holder portion extending downwardly from the intermediate portion at the distal end of the hook.

3. The combination as defined in claim 1 wherein the hook includes an upwardly extending distal end portion and the elongate portion of the tag includes a slot receiving the distal end portion of the hook.

4. The combination as defined in claim 1 wherein the mounting portion includes reinforcing means extending perpendicularly to the first slot on opposite sides thereof.

5. The combination as defined in claim 1 wherein the mounting portion includes a second transverse slot spaced from the first slot.

6. The combination as defined in claim 1 wherein the support means is a flat bar.

* * * * *